US011427370B2

(12) United States Patent
Goeffers et al.

(10) Patent No.: US 11,427,370 B2
(45) Date of Patent: Aug. 30, 2022

(54) CONTAINER WITH A COLLAPSIBLE PORTION

(71) Applicant: Creanovate Limited, Isleworth (GB)

(72) Inventors: All-Noor Goeffers, Isleworth (GB); Zuaina Nizar, Isleworth (GB)

(73) Assignee: Creanovate Limited, Isleworth (GB)

( * ) Notice: Subject to any disclaimer, the term of this patent is extended or adjusted under 35 U.S.C. 154(b) by 0 days.

(21) Appl. No.: 16/767,058

(22) PCT Filed: Nov. 26, 2018

(86) PCT No.: PCT/GB2018/053406
§ 371 (c)(1),
(2) Date: May 26, 2020

(87) PCT Pub. No.: WO2019/106347
PCT Pub. Date: Jun. 6, 2019

(65) Prior Publication Data

US 2020/0369427 A1 Nov. 26, 2020

(30) Foreign Application Priority Data

Nov. 28, 2017 (GB) ..... 1719721

(51) Int. Cl.
*B65D 1/02* (2006.01)
*B65D 1/46* (2006.01)

(52) U.S. Cl.
CPC ..... *B65D 1/023* (2013.01); *B65D 1/0292* (2013.01); *B65D 1/46* (2013.01); *B65D 2501/0036* (2013.01)

(58) Field of Classification Search
CPC ..... B65D 1/0292; B65D 1/40; B65D 1/023; B65D 1/46; B65D 21/086; B65D 25/46;
(Continued)

(56) References Cited

U.S. PATENT DOCUMENTS 3,323,694 A * 6/1967 Stevens, Jr. ..... B65D 47/103 222/498
4,572,412 A * 2/1986 Brach ..... B65D 1/0223 215/382

(Continued)

FOREIGN PATENT DOCUMENTS

AR 097119 2/2016
DE 199 05 449 8/2000

(Continued)

OTHER PUBLICATIONS

ASTM D2659, "Crush Plastic Blown Containers Test Equipment" (Abstract).

(Continued)

*Primary Examiner* — Allan D Stevens
(74) *Attorney, Agent, or Firm* — Levy & Grandinetti

(57) ABSTRACT

A container has a body portion, a collapsible portion, and an outlet aperture arranged on the collapsible portion, in which the collapsible portion is collapsible from a start configuration in which the outlet aperture is aligned with an axis, to a collapsed configuration in which the outlet aperture is rotated from the axis, in which the collapsible portion has a bracing section which is shaped and configured to support the collapsible portion against collapse when the outlet aperture is subjected to a first force applied in line with the axis, and in which the collapsible portion has a structurally weakened section which is shaped and configured to fail in a non-resilient manner when subjected to a second force applied from an offset angle to the axis.

5 Claims, 7 Drawing Sheets

(58) Field of Classification Search
CPC ..... B65D 25/465; B65D 2501/0054; A61J 9/005; Y10S 215/90
See application file for complete search history.

(56) References Cited

U.S. PATENT DOCUMENTS

| | | | | |
|---|---|---|---|---|
| 4,572,413 | A * | 2/1986 | Vogt | B65D 17/06 222/528 |
| 6,796,712 | B1 * | 9/2004 | Achhammer | B65D 75/5883 383/80 |
| 8,052,071 | B2 * | 11/2011 | Kruse | B05B 7/2478 239/345 |
| 8,794,459 | B2 * | 8/2014 | Dover | B65D 1/023 215/40 |
| 2003/0168426 | A1 | 9/2003 | Yourist | |
| 2017/0158370 | A1 | 6/2017 | Kuhar et al. | |

FOREIGN PATENT DOCUMENTS

| | | |
|---|---|---|
| EP | 1 026 085 | 8/2000 |
| EP | 1 884 473 | 2/2008 |
| FR | 2 765 555 | 1/1999 |
| JP | S58-167012 | 11/1983 |
| JP | 2010-06424 | 1/2010 |
| JP | 2016-108017 | 6/2016 |
| KR | 2001-0078978 | 8/2001 |

OTHER PUBLICATIONS

ISO 12048, "Packaging—Complete, filled transport packages—Compression and stacking tests using a compression tester" (1994).

* cited by examiner

CONTAINER WITH A COLLAPSIBLE PORTION

The present invention relates to a container with a collapsible portion, for use particularly, but not exclusively, as a soft drinks bottle made from a plastics material.

Bottles typically have an outlet aperture at the top, which is aligned with the axis of the bottle. As such, to pour a liquid from a bottle into a receptacle it is necessary to rotate the bottle sufficiently to allow the liquid to pass through the outlet aperture. This can be difficult with large bottles, such as those with a capacity of 2 litres or more, because they are heavy and can be awkward to manipulate. To drink a liquid from a bottle directly requires the bottle to be elevated in relation to the user, from anywhere between about 45 degrees to 180 degrees from an upright position. Once again, this can be an awkward movement if the bottle is heavy, or if the user has a disability. In particular if the user tilts their head back when drinking from the bottle, this can place a strain on their neck muscles. If the bottle is a large one, for example more than 1 litre, then these problems are exacerbated.

It is known to provide drinking bottles with an outlet aperture which is at an offset angle to the axis of the bottle, for example at 45 degrees thereto, in order to make it easier to drink directly therefrom. This alleviates the stress placed on a user's neck by reducing the rotation angle required. It also makes the bottle easier to use when dispensing the contents into a receptacle. It is also know to provide other types of bottles with shapes or fixtures to make them easier to dispense from, such as curved spouts and the like.

The majority of bottles used to package water and soft drinks are stretch blow moulded PET (polyethylene terephthalate) bottles made from preforms which are stretched and inflated inside a mould to form a particular shape. This method of manufacture is widely used because it is fast and cost effective. It involves a preform of PET being axially located in the mould, and then stretched and inflated therein to form the final shape. Once the bottles are made they are filled and closed. All existing bottling plants use machines which are designed to fill a bottle from above, through an aperture which is axially aligned with the bottle, and then also apply a cap from above. As such, a bottle which was manufactured with an aperture which was at an offset angle to the axis of the bottle would require an entirely new bottling machine in order to fill it with product and then to cap it.

In addition, bottled soft drinks are usually stacked on pallets for storage and transportation. It is common for up to six or more stacks of bottles to be piled up in this way. If so, it is necessary for the bottles to be capable of withstanding the combined weight of the products stacked above them without collapsing. This is possible when the bottle has a neck, outlet and cap which are all axially aligned with the axis of the bottle, because such a structure is strong enough to withstand a considerable axial compression force. This strength of the bottle is increased by the contents, and by any pressure introduced to the bottle, and it may also be supported by additional lateral packaging, such as a plastics material wrapped around six bottles. These factors are all considered when designing a bottle, and it would not be possible to provide the same kind of axial bottle strength if the neck and outlet were at an offset angle to the axis of the bottle. Alternative more expensive storage and transportation would have to be provided.

The present invention is intended to overcome some of the above described problems.

Therefore, according to the present invention a container comprises a body portion, a collapsible portion and an outlet aperture arranged on said collapsible portion, in which said collapsible portion is collapsible from a start configuration in which said outlet aperture is aligned with an axis, to a collapsed configuration in which said outlet aperture is rotated from said axis, in which said collapsible portion comprises a bracing section which is shaped and configured to support said collapsible portion against collapse when said outlet aperture is subjected to a first force applied in line with said axis, and in which said collapsible portion comprises a structurally weakened section which is shaped and configured to fail in a non-resilient manner when subjected to a second force applied from an offset angle to said axis.

Thus, the present invention provides a container which can maintain its shape when subjected to an axial loading, such as is experienced by bottles made from plastics materials when further such bottles are stacked on top of them for storage and transport, but which can also collapse when subjected to the second force in order to provide a more convenient drinking vessel with an outlet aperture which is at an offset angle to the axis of the container.

It will be appreciated that there are numerous technical ways in which a collapsible portion can be shaped and configured to achieve the above described results. All that is necessary technically is a bracing section which is physically capable of supporting the collapsible section against collapse when the outlet aperture is subjected to the first force, and a structurally weakened section which is physically capable of failing in a non-resilient manner when subjected to the second force. There are many possible shapes which can conform to this requirement.

In terms of the principal use of the present invention for soft drinks bottles made from plastics materials, there are numerous possible design variables which can be chosen by the skilled person according to the specific requirements of a particular product. In particular, the inherent axial strength of a bottle made from a plastics material will vary depending on its shape and size, and also on whether it is filled with liquid, to what degree it is filled with liquid, and whether that liquid is pressurised. The shape and size of any cap applied to the bottle will also have an effect. The volume of the bottle may also be a design consideration, and the larger it is the greater the strain which may be placed upon it. Furthermore, the degree to which the designer wants the collapsible portion to collapse is also a consideration. They may desire a lesser degree of collapse in some instances than others, in order to satisfy functionality and/or aesthetic requirements.

Therefore, the location of the structurally weakened section, its shape, and its overall size can be chosen to suit a particular design brief.

The first force which the bracing section is designed to withstand can be any pre-determined size, according to the manufacturing, storage and transportation requirements of a particular product design. As such, it may need to be stronger in some instances than in others. For example, PET bottles need to be able to withstand forces they will experience during the filling process, the capping process, transportation and warehouse stacking. They may need to pass top-load tests according to international standards such ASTM D2659 or ISO 12048 to verify their ability to withstand such forces. To achieve this the design of the bracing section and/or the structurally weakened section can be altered accordingly, and several variations with different load bearing capabilities are described below. All that is required for the invention to be performed is that the collapsible portion is capable of withstanding the pre-determined first force in question which is applied.

The second force can be any bending moment which enables the collapse of the collapsible portion. This can be a single force applied at any point about an axis of rotation which dissects the collapsible portion, and about which the outlet aperture rotates when the collapsible portion collapses, or it can be a set of different forces applied at a plurality of different points about the axis of rotation which dissects the collapsible portion. In particular, a single force can be applied to the region of the outlet aperture in the direction of rotation of the outlet aperture about the axis of rotation, or it can be applied to the structurally weakened section directly. In other words the user can pull or push the outlet aperture towards them to apply a generally lateral compression force to the structurally weakened section, or they can depress the structurally weakened section directly to apply a more direct compression force thereto. The user can also apply such multiple such forces simultaneously to achieve the same end.

The second force can be a pre-determined size, according to the collapsing characteristics desired. For example, it may be desired that the collapsible portion can be collapsed when it is subjected to a small second force, for example if the product is for children, or it may be desired that the collapsible portion can be collapsed when it is subjected to a larger second force, for example if a more dramatic collapsing movement is desired. In addition to this, the nature of the product has an impact on the way the collapsible portion can be collapsed, and the size of the second force required to do so. For example the internal pressure inside the container will determine the degree and nature of the deformation which is possible under manual manipulation. In terms of the principal use of the present invention for soft drinks bottles made from plastics materials, the second force can be chosen to apply when such a bottle is empty, filled, filled and capped or empty and capped, although obviously filled and capped is the most relevant consideration. It will be appreciated though that the size of the second force which will lead to collapse of the collapsible portion is largely affected by the status of the container, and that will have to be factored into the design. In addition to this, the final deformed shape of the container will also be affected by its initial status, and again this will have to be factored into the design, so the deformation is as desired in use. To achieve all these results the design of the structurally weakened section and/or the bracing section can be altered accordingly, and several variations with different collapsing characteristics are described below. All that is required for the invention to be performed is that the collapsible portion collapses when it is subjected to the pre-determined second force in question.

Although not an essential feature of the present invention, it is preferable that the collapsible portion remains watertight in the collapsed configuration. With a material like PET it is possible to deform it in a non-resilient manner as described above without compromising its integrity.

Preferably the collapsible portion can comprise a three dimensional shape aligned with the axis and comprising a base connected to the body portion, a top at which the outlet aperture can be positioned and a central portion which can taper inwardly from the base to the top. The tapering shoulders of known bottles made from plastics materials are this shape. The bracing section can then comprise an area of the central portion which transmits the first force from the top to the base. The tapering shoulder of a bottle is suitable for transmitting and dispersing such a force given its inherently stable shape.

The structurally weakened section can be any structural formation which is weaker than the surrounding parts of the central portion. This could include a section with a smaller thickness, but this would be complex to manufacture. Preferably the structurally weakened section can comprise a discontinuity formed in the central portion which extends both axially and circumferentially of the central portion. A "discontinuity" means a section which is displaced or has a different shape from the otherwise continuous axially and radially extending shape of the central portion. In one version of the invention the central portion can comprise an outer surface, and the discontinuity can comprise an area of the outer surface which is recessed.

It will be appreciated that it is possible to create such a recessed area using the known bottle moulding process. It is simply a question of using a mould comprising a pronounced area about which the plastics material of the bottle settles. Therefore, this kind of structurally weakened section can be formed without deviating from known manufacturing techniques.

The structurally weakened section can be any shape which can fail in a non-resilient manner when subjected to the second force. However, in one possible version of the invention the discontinuity can comprise an upper edge which can extend circumferentially in a plane normal to the axis, and a lower edge which can be parallel to the upper edge. This configuration creates a pair of axially spaced circumferentially extending lines of weakness. The second force can then be applied between them to force them to buckle, and subsequently force the collapsible portion to collapse in on those lines of weakness in a non-resilient manner. It will be appreciated that a failure of this kind will not only re-shape the structurally weakened section, but a large part of the collapsible portion around it. It will also displace the outlet aperture at the top, and rotate it from being aligned with the axis to being at an offset angle thereto. The precise final angle achieved may differ each time, depending on way the collapsible portion collapses. Preferably it is between 20 and 40 degrees.

The second force can be manually applied by a user, who can press on the structurally weakened section with their fingers or thumbs in order to force the upper edge and/or the lower edge to buckle, and reconfigure the collapsible portion into the collapsed configuration. They can further assist this action by pulling the outlet aperture towards the structurally weakened section.

The discontinuity forming the structurally weakened section can comprise a right edge which can extend axially between the upper edge and the lower edge, and a left edge which can extend axially between the upper edge and the lower edge. The right edge and the left edge can be straight, but they can also be rounded, curved or tapered, so as to better assist the degree to which the structurally weakened section can be collapsed in on itself.

As referred to above, the bracing section can comprise an area of the central portion which transmits the first force from the top to the base. This can be all of the central portion other than the structurally weakened section, but it will be appreciated that it can also include the structurally weakened section to a degree, because the structurally weakened section may still be capable of transmitting some of the first force from the top to the base. Therefore, the bracing section can refer to parts of the collapsible portion which include the structurally weakened section.

Therefore, the bracing section can comprise a main part comprising the central portion other than the discontinuity, and a secondary part comprising the discontinuity, which secondary part can transmit less of the first force from the top to the base than the main part.

In an alternative to the above described recessed discontinuity, it can instead comprise an area of the outer surface which is pronounced. Functionally such a structure can operate in the same was as a recessed area, but it will have different aesthetics which may be preferred, both when the collapsible portion is in the start configuration and when it is in the collapsed configuration. In the start configuration the pronounced area can form a shape which diverges more from the traditional bottle shoulder shape. In the collapsed configuration the pronounced area will fail outwardly rather than inwardly, which may produce a different look.

A potential issue which has been identified during development of the present invention is that the speed of some known bottling processes depends on the speed with which a bottle can be filled with liquid. To achieve a high filling speed known filling machines spray the product along the internal walls of the neck and shoulder of the bottle leaving the central axial part of the neck free for air in the bottle to escape. This principal requires the neck and the shoulder of the bottle to be as free as possible from obstacles which could hinder the flow of the liquid along the shoulder and into the main body of the bottle. In some situations some of above described versions of the invention may present too great an obstacle.

Therefore, in another possible version of the invention an upper edge of the discontinuity can be radially aligned with the bracing section relative to the axis, and the amount to which the discontinuity is recessed relative to the bracing section can increase axially from the upper edge to the lower edge. With this construction the discontinuity takes the form of a ramp on the inside surface of the shoulder of the bottle, over which liquid can easily flow when the bottle is being filled.

Another way to deal with this issue is to reduce the recessed nature of the discontinuity to the minimum possible, and to make the transition between the structurally weakened section and the bracing section as smooth as possible. However, in order to still provide for a structurally weakened section which functions according to the invention, its footprint needs to increase in size. Therefore, in yet another possible version of the invention the discontinuity can comprises an outline which extends around the axis. Therefore, in this version of the invention the structurally weakened section is spread over a relatively large area of the shoulder of the bottle, and actually encompasses the neck of the bottle.

Preferably the outline can comprise a first section which extends substantially 180 degrees around the axis at a consistent first radial distance therefrom, and a second section which extends substantially 180 degrees around the axis at varying radial distances therefrom which are less than the first radial distance. It has been found that this shape of outline results in a neat collapsing movement of the collapsible portion.

The same kind of enlarged structurally weakened section can be created with a pronounced discontinuity rather than a recessed one. As such, in a further possible embodiment the structurally weakened section can comprise a pronounced discontinuity which can comprise an outline which extends around the axis. Again, preferably the outline can comprise a first section which extends substantially 180 degrees around the axis at a consistent first radial distance therefrom, and a second section which extends substantially 180 degrees around the axis at varying radial distances therefrom which are less than the first radial distance.

In other alternative embodiments to those described above the structurally weakened section can comprise a plurality of discontinuities formed in the central portion, each of which extends both axially and circumferentially of the central portion. These versions of the invention allow the collapsible portion to be collapsed in multiple different directions, and in addition the presence of more than one discontinuity may also assist the movement of the collapsible portion from the start configuration to the collapsed configuration.

There can be two discontinuities, one on either side of the collapsible portion, or there can be three, four or more, which can be spread around the collapsible portion.

Each of the plurality of discontinuities can comprise an upper edge which can extend circumferentially in a plane normal to the axis, a lower edge which is parallel to the upper edge, a right edge which can extend axially between the upper edge and the lower edge, and a left edge which can extend axially between the upper edge and the lower edge, and the plurality of discontinuities can be circumferentially spaced apart from one another.

As with versions of the invention comprising only one discontinuity, the bracing section can comprise a main part comprising the central portion other than the plurality of discontinuities, and a secondary part comprising the plurality of discontinuities, which secondary part can transmit less of the first force from the top to the base than the main part.

Further, when there are a plurality of discontinuities which are circumferentially spaced from one another, the bracing section can comprise strut portions which are disposed between the discontinuities. These strut portions can provide a balanced way to transmit the first force from the top to the base, which is better spread around the circumference of the collapsible portion.

As with versions of the invention comprising only one discontinuity, the central portion can comprise an outer surface, and each of the plurality of discontinuities can comprises an area of the outer surface which is recessed, or they can comprise an area of the outer surface which is pronounced.

In order to address the issues associated with filling the bottle with liquid quickly, in one version of the invention the upper edges of the plurality of discontinuities can be radially aligned with the bracing section relative to the axis, and the amount to which each of the plurality of discontinuities is recessed relative to the bracing section can increase axially from its upper edge to its lower edge.

In other versions of the invention the plurality of discontinuities can each comprise an upper edge which can extend both axially and circumferentially in relation to the axis, and a lower edge which can also extend both axially and circumferentially in relation to the axis. In other words, each discontinuity can be a shape more complex than a curve. This can allow shapes which may be more aesthetically pleasing, or even appropriate in the sense that they can be made to look like an ingredient of a product to be placed in the container, such as an apple or a strawberry.

It will be appreciated that the invention can be used with any shape of container. However, in a preferred construction the container can comprise a cylindrical bottle constructed from a plastics material, and the collapsible portion can comprise an annular tapering shoulder of the bottle. The particular plastics material used can be any of the known types, including PET (polyethylene terephthalate) or PP (polypropylene).

The invention can be performed in various different ways, but nine embodiments now be described by way of example, and with reference to the accompanying drawings, in which.

Figure 1:
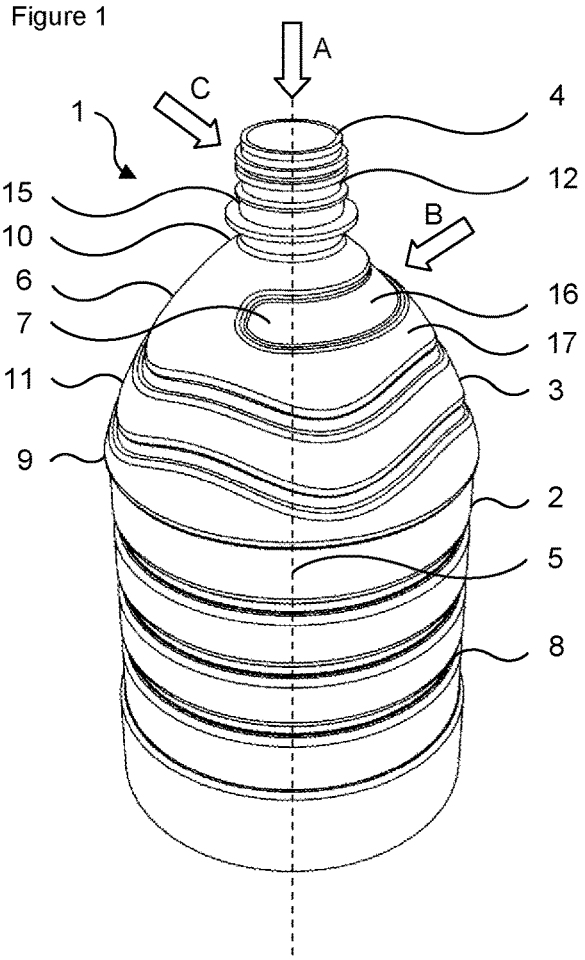
FIG. 1 is a perspective view of a first container according to the present invention in a start configuration.
Figure 2:
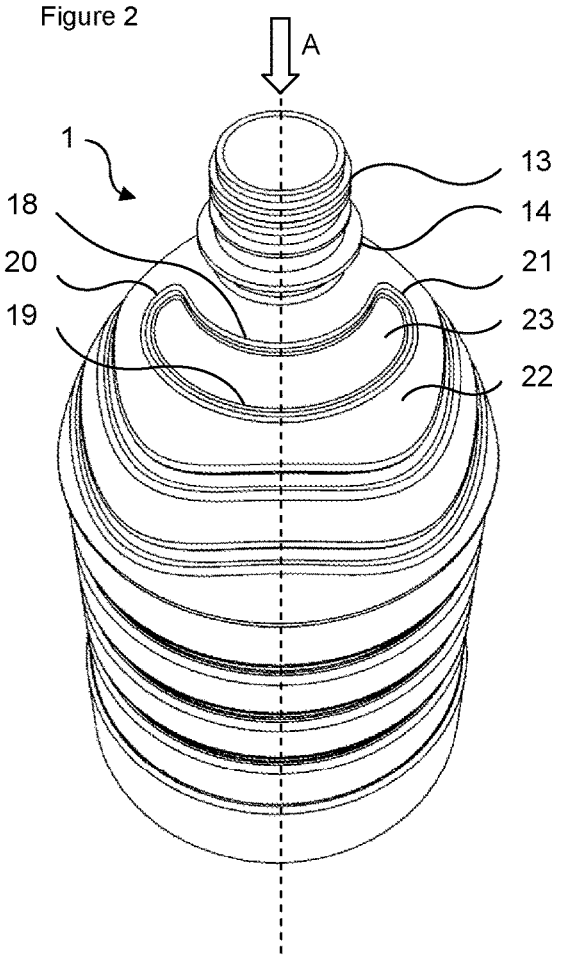
FIG. 2 is a perspective view of the first container as shown in FIG. 1.
Figure 3:
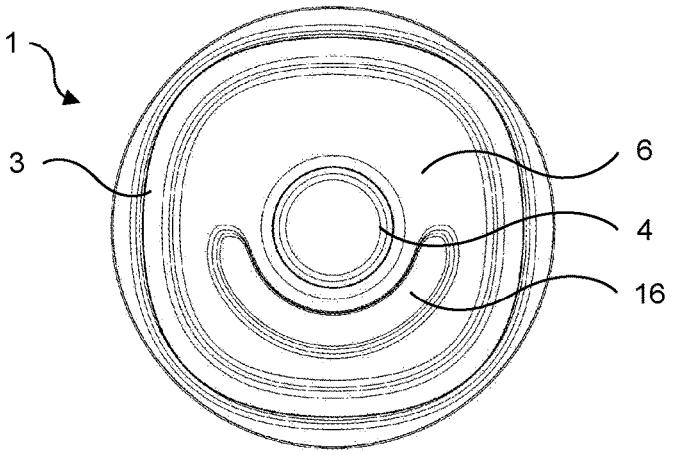
FIG. 3 is a top view of the first container as shown in FIG. 1
Figure 4:
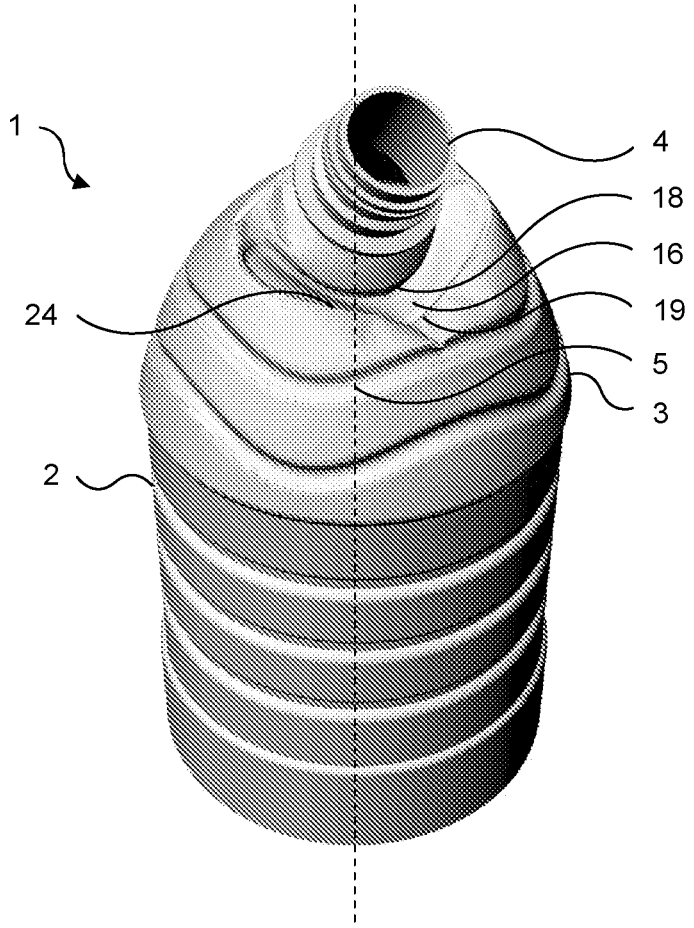
FIG. 4 is a perspective view of the first container as shown in FIG. 1 in a collapsed configuration.
Figure 5:
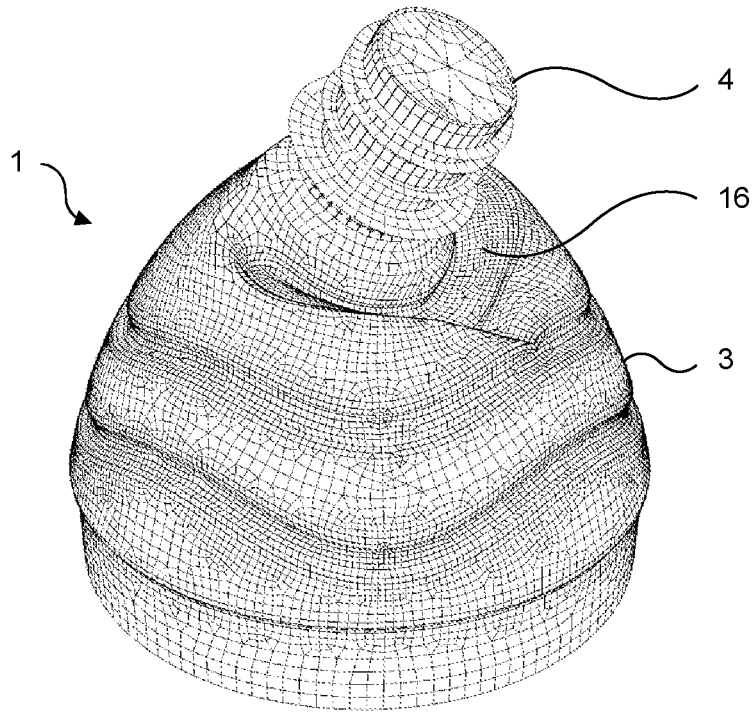
FIG. 5 is a partial frame view of the first container as shown in FIG. 4.

As shown in FIGS. 1 to 3 a container, in the form of PET bottle 1, comprises a body portion 2, a collapsible portion, in the form of shoulder 3, and an outlet aperture 4 arranged on the collapsible portion (3). As described further below, the collapsible portion (3) is collapsible from a start configuration as shown in FIGS. 1 to 3 in which outlet aperture 4 is aligned with an axis 5, to a collapsed configuration as shown in FIGS. 4 and 5, in which the outlet aperture 4 is rotated from the axis 5. The collapsible portion (3) comprises a bracing section 6 which is shaped and configured to support the collapsible portion (3) against collapse when the outlet aperture 4 is subjected to a first force, as indicated by arrow A, applied in line with the axis 5. The collapsible portion (3) also comprises a structurally weakened section 7 which is shaped and configured to fail in a non-resilient manner when subjected to a second force, as indicated by arrows B and/or C, applied from an offset angle to the axis 5.

The bottle 1 is like known PET stretch blow moulded bottles, and it comprises a generally cylindrical body portion 2, which has aesthetic shapes 8 formed in it as a result of the shape of the mould used. The shoulder 3 of the bottle 1 is a three dimensional shape aligned with axis 5, and comprises a base 9 connected to the body portion 2, a top 10 at which the outlet aperture 4 is positioned and a central portion 11 which tapers inwardly from the base 9 to the top 10. The central portion 11 has some aesthetic shapes 8 formed in it, as is known, and these are incidental to the present invention. At the top 10 of the shoulder 3 a cylindrical neck 12 is formed, which has a screw thread 13 and a support flange 14 formed on an outer surface 15 thereof, which is for co-operation with a screw cap (not shown) in the known way.

As referred to above, the shoulder 3 is the collapsible portion of the present invention. It comprises the structurally weakened section 7, which is a discontinuity formed in the central portion 11, which as is clear from the Figures extends both axially and circumferentially of the central portion 11. This discontinuity is in the form of a recessed area 16 formed in the outer surface 17 of the central portion 11. The recessed area 16 comprises similar axial and circumferential curvatures as the surrounding parts of the central portion 11, and as such the depth of the recessed area 16 is uniform across its area.

The recessed area 16 is formed during the moulding process of the bottle 1. Namely, the mould used in the stretch blow moulding process comprises a pronounced part about which the PET material is shaped so as to form the recessed area 16. As such, the bottle 1 is manufactured using the same stretch blow moulding process that is widely used, and the only difference is the shape of the mould used.

The recessed area 16 comprises an upper edge 18 which extends circumferentially in a plane normal to the axis 5, and a lower edge 19 which is parallel to the upper edge 18. As is clear from the Figures this configuration creates a pair of axially spaced circumferentially extending lines of weakness where the recessed area 16 is offset from the rest of the central portion 11.

The recessed area 16 also comprises a right edge 20 which extends axially between the upper edge 18 and the lower edge 19, and a left edge 21 which extends axially between the upper edge 18 and the lower edge 19. As is clear from FIGS. 1 to 3 the right edge 20 and the left edge 21 are slightly tapered. This is to better assist the degree to which the recessed area 16 can be collapsed in on itself, as described further below.

As referred to above, the shoulder 3 also comprises a bracing section 6, which comprises an area of the central portion 11 which transmits the first force A from the top 10 to the base 9. The bracing section 6 comprises a main part 22, being the central portion 11 other than the recessed area 16, but because the recessed area 16 is also capable of transmitting some of first force A in an axial direction, the bracing section 6 also comprises a secondary part 23 being the recessed area 16 itself.

In use the bottle 1 operates as follows. The bottle 1 is shown empty and uncapped in the Figures, but during manufacture it is first filled with water, then a cap (not shown) is fitted to the neck 12. During this manufacturing process any first force A which is applied is born by the bracing section 6, and the shoulder 3 does not collapse.

The bottle 1 may then be stored and transported on a pallet. If so, it may have a number of other products stacked on top of it. The force applied in these circumstances is force A. The bottle 1 is shaped and configured to be able to withstand force A without collapsing. In particular, the thickness of the PET used, and the shape and extent of the main part 22 of the bracing section 6, are sufficient for the shoulder 3 to withstand at least force A without collapsing when the bottle is filled with water and capped. It will be appreciated that the water inside the bottle 1, as well as the cap structure, increases the axial stiffness of the bottle 1 in this condition, which is taken into account in the design. At the same time, the shape, size and configuration of the recessed area 16, including the upper edge 18, lower edge 19, right edge 20 and left edge 21 are such that force A does not cause these areas of deliberate weakness to buckle. Again, this is the case when the bottle is filled with water and caped.

When the user acquires the bottle 1 and wishes to drink from it, they can move the shoulder 3 from the start configuration as shown in FIGS. 1 to 3 to the collapsed configuration as shown in FIGS. 4 and 5, by applying the second force, which can be a single force B applied to the recessed area 16, or single force C applied to the neck 12, or a combination of forces B and C.

The second force B and/or C can be manually applied by a user, who can press on the recessed area 16 with their fingers or thumbs to apply force B in order to force the upper edge 18 and/or the lower edge 19 to buckle, and reconfigure the shoulder 3 into the collapsed configuration as shown in FIGS. 4 and 5. As an alternative to this, they can manually pull or push the neck 12 towards the recessed area 16 to apply force C. The system works best if the user presses on the recessed area 16 with their fingers or thumbs to apply force B, while also holding the neck 12 with their other fingers and pulling the neck 12 towards the recessed area 16 to apply force C at the same time.

The second force B and/or C is essentially a bending moment which enables the collapse of the shoulder 3, and this moment can be applied at any point about an axis of rotation which dissects the shoulder 3, and about which the outlet aperture 4 rotates as it moves from the position shown in FIGS. 1 to 3 to that shown in FIGS. 4 and 5. So, as described above the second force B and/or C can be applied to neck 12 in the direction of rotation of the outlet aperture 4 about the axis of rotation, and/or it can be applied to the recessed area 16 directly.

As shown in FIGS. 4 and 5, the application of the second force B and/or C forces the upper edge 18 and the lower edge 19 to buckle, which subsequently forces the recessed area 16 to collapse in on itself. This collapse is non-resilient in the sense that the shoulder 3 is permanently distorted, and the PET material of the bottle 1 does not resiliently return to the start configuration shown in FIGS. 1 to 3. As is clear from FIGS. 4 and 5, a failure of this kind not only re-shapes the recessed area 16, but also a large part of the shoulder 3 around it. In particular, in the example shown in FIGS. 4 and 5 the shoulder 3 has crumpled and formed a fold line 24 which extends beyond the recessed area 16.

As is also clear from FIGS. 4 and 5, in the collapsed configuration the outlet aperture 4 is positioned at an oblique final angle to the axis 5 of about 40 degrees. It will be appreciated that this final angle is achieved for a number of reasons. In particular, the particular location of the recessed area 16 on the shoulder 3 closer to the top 10 than the base 9, as well as the proximity of the upper edge 18 and lower edge 19, mean that the recessed area 16 collapses to the configuration shown in FIGS. 4 and 5, with the outlet aperture 4 at about 40 degrees. To increase the final angle to more than 40 degrees the recessed area could be enlarged, so the upper edge 18 and lower edge 19 were further apart, or the recessed area 16 could be located closer to the base 9. Looking at this another way, the shape of the shoulder 3 is a contributing factor to the final angle achieved. For example, the more spherical a shoulder is, the more the vertical location of a recessed area will have an impact, because its axial position will determine its initial angle of inclination in relation to the axis. As such, the higher up on a spherically shaped shoulder a recessed area is the lower the final angle will be. Shoulder 3 comprises a curvature but it is relatively minor, however it is taken into consideration, and the vertical position of the recessed area 16, and therefore its initial angle of inclination in relation to the axis 5, means that the final angle achieved is 40 degrees. To increase this the recessed area 16 could be located lower down closer to the base 9, which reduces its initial angle of inclination. Therefore, it will be appreciated that the desired final angle is a matter of design choice for the skilled person, who can adjust it by changing any number of variable technical features of the shoulder 3 or the recessed area 16.

It will also be appreciated that the nature of the invention is such that the collapsed configuration will be slightly different each time. The manner in which the PET material collapses is not precisely controlled, and as such the appearance, and the final angle of the outlet aperture 4 will vary slightly.

In the collapsed configuration the bottle 1 remains watertight, because the PET material of the shoulder 3 is sufficiently resilient not to tear or crack when subjected to the collapsing action described above.

Once the shoulder 3 has been placed in the collapsed configuration the cap (not show) can be removed from the neck 12 and the user can drink from the bottle 1, or pour the contents into a receptacle. When they perform these actions it is easier than with a conventional bottle shape because a much lower angle of rotation is required to dispense the contents.

It will be appreciated that it would also be possible to first remove the cap (not shown) from the neck 12 and then apply the second force B and/or C as described above. If so, a lesser force is required to move the shoulder 3 into the collapsed configuration because the resistance to collapsing provided by the internal pressure inside the closed bottle 1 is removed. However, depending on how full the bottle 1 is, performing the collapsing action with the cap removed may lead to undesirable spillage.

The bottle 1 shown in FIGS. 1 to 5 is characterised by the fact that the recessed area 16 is asymmetric of the central portion 11. It will be appreciated that this is fundamentally a weak structure in relation to force A, because the loading applied is not spread equally across the shoulder 3. As such, this particular design of bottle may be more suitable for use with 33 cl bottles, which are stiffer than larger bottles such as 1.5 litre or 2 litre bottles if the thickness of PET used is the same.

Figure 6:
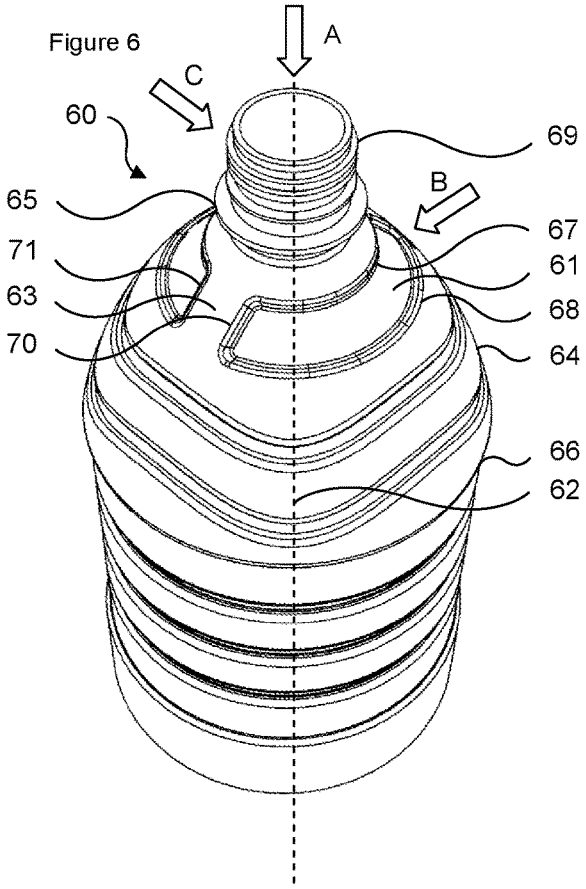
FIG. 6 is a perspective view of a second container according to the present invention in a start configuration.
Figure 7:
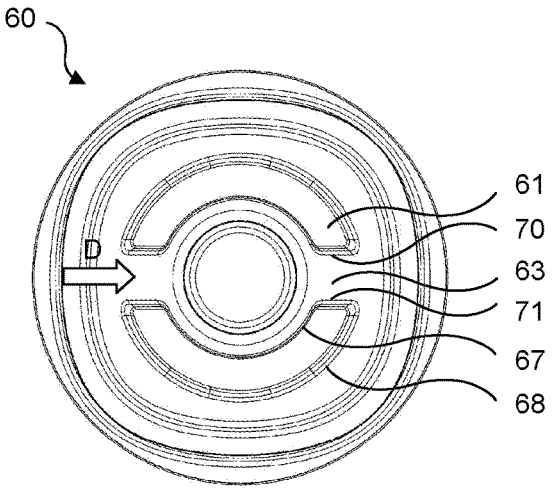
FIG. 7 is a top view of the second container as shown in FIG. 6.

Referring now to FIGS. 6 and 7, these show a second embodiment of the present invention in which bottle 60 is similar to bottle 1 described above, but instead of a single recessed area, it features two recessed areas 61 which are symmetrical about axis 62. These recessed areas 61 are similar in shape and configuration to recessed area 16 described above, but their circumferential extent is less, such that a pair of symmetrical strut portions 63 are disposed between them.

It will be appreciated that the shoulder 64 of bottle 60 has a symmetrical shape, which makes it inherently stronger and able to withstand a greater axial loading than bottle 1. This is because such a loading in the form of force A is equally dispersed on either side of shoulder 64 and better transmitted from the top 65 to the base 66. As such, bottle 60 is more suited to a medium sized bottle such as a 50 cl or 75 cl bottle, which is less stiff than a 33 cl bottle with the same thickness of PET.

In use the shoulder 64 of bottle 60 can be moved from the start configuration shown in FIGS. 6 and 7 to a collapsed configuration in a number of different ways. Firstly, it can be collapsed in the manner described above when referring to bottle 1 in two opposite directions due to the two opposite recessed areas 61 provided. A user can press on a recessed area 61 with their fingers or thumbs to apply force B to force the upper edge 67 and/or the lower edge 68 to buckle. They can further assist this action by pulling the neck 69 towards the recessed area 61 to apply force C. The shoulder 64 will then collapse in much the same way as shoulder 3 described above.

Alternatively, it is also possible to apply another second force in the form of force D directly onto one of the strut portions 63 until it buckles. In essence, in the axial region between the level of the upper edge 67 and the lower edge 68 of the recessed areas 61, the strut portions 63 constitute a discontinuity, because they are pronounced in relation to the recessed areas 61. As such, the structural weakness provided by the right edge 70 of one recessed area 61 and the left edge 71 of the other recessed area 61 can be employed to generate a movement to a collapsed configuration in a non-resilient manner. What actually happens is that the strut portion 63 buckles and both the right region of one recessed area 61 and the left region of the other recessed area 61 are forced to collapse into the region of the strut portion 63 between them. This may produce a different final angle of spout 69 to if a recessed area 61 is employed to move the shoulder 64 into the collapsed configuration. It will be appreciated that however the shoulder 64 is collapsed, each of the forces B, C or D are always applied from an offset angle to the axis 62.

Figure 8:
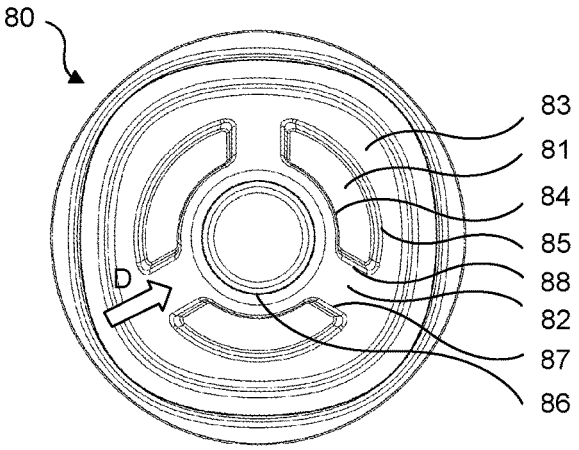
FIG. 8 is a top view of a third container according to the present invention in a start configuration.

Referring now to FIG. 8, this shows a third embodiment of the present invention in which bottle 80 is similar to bottles 1 and 60 described above, but instead of one or two recessed areas, it comprises three 81. These recessed areas 81 are similar in shape and configuration to recessed areas 16 and 61 described above, but their circumferential extent is less, such that three strut portions 82 are disposed between them.

It will be appreciated that the shoulder 83 of bottle 80 has three lines of symmetry, which makes it inherently stronger and able to withstand a greater axial loading than bottles 1 and 60. There are now three strut portions 82 which stiffen the shoulder 83, further increasing the resistance to buckling under force A. As such, bottle 80 is more suited to a larger sized bottles such as 1 litre or 1.5 litre bottles, which are less stiff in the shoulder area than smaller bottles with the same thickness of PET.

In use the shoulder 83 of bottle 80 can be moved from the start configuration shown in FIG. 8 to a collapsed configuration in a number of different ways. Firstly, it can be collapsed in the manner described above when referring to bottle 1 in three different directions due to the three recessed areas 81 provided. A user can press on a recessed area 81 with their fingers or thumbs to force the upper edge 84 and/or the lower edge 85 to buckle. They can further assist this action by pulling the neck 86 towards the recessed area 81. The shoulder 83 will then collapse in the same manner as shoulder 3 described above.

Alternatively, it is also possible to apply force D directly onto one of the strut portions 82 until it buckles. In essence, in the axial region between the level of the upper edge 84 and the lower edge 85 of the recessed areas 81, the strut portions 82 constitute discontinuities, because they are pronounced in relation to the recessed areas 81. As such, the structural weakness provided by the right edge 87 of one recessed area 81 and the left edge 88 of the adjacent recessed area 81 can be employed to generate a movement to a collapsed configuration in a non-resilient manner. What actually happens is that the strut portion 82 buckles and both the right region of one recessed area 81 and the left region of the adjacent recessed area 81 are forced to collapse into the region of the strut portion 82 between them. This may produce a different final angle of neck 86 to if a recessed area 81 is employed to move the shoulder 83 into the collapsed configuration. Once again, it will be appreciated that however the shoulder 83 is collapsed, each of the forces B, C or D are always applied from an offset angle to the axis 62.

Figure 9:
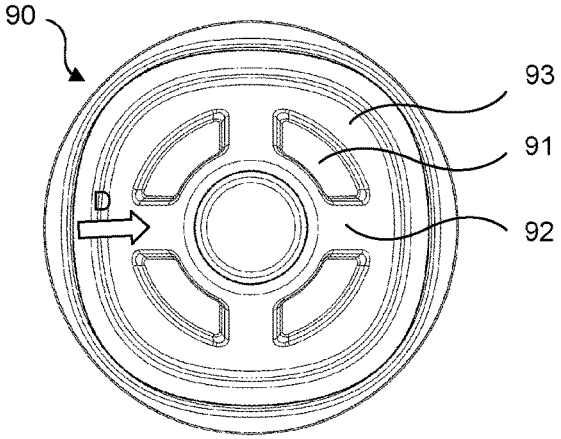
FIG. 9 is a top view of a fourth container according to the present invention in a start configuration.

Referring now to FIG. 9, this shows a fourth embodiment of the present invention in which bottle 90 is similar to bottles 1, 60 and 80 described above, but it comprises four recessed areas 91. Again, these recessed areas 91 are similar in shape and configuration to recessed areas 16, 61 and 81 described above, but their circumferential extent is less, such that four strut portions 92 are disposed between them. The shoulder 93 of bottle 90 is therefore even stronger, and this design is suitable for large bottles such as 2 litre bottles, which are less stiff in the shoulder area than smaller bottles with the same thickness of PET.

In use the shoulder 93 of bottle 90 operates in the same way as shoulder 83 described above, except the recessed areas 91 allow for it to be collapsed in four different directions. Again, it is also possible to apply force D directly onto one of the strut portions 92 until it buckles.

Figure 10:
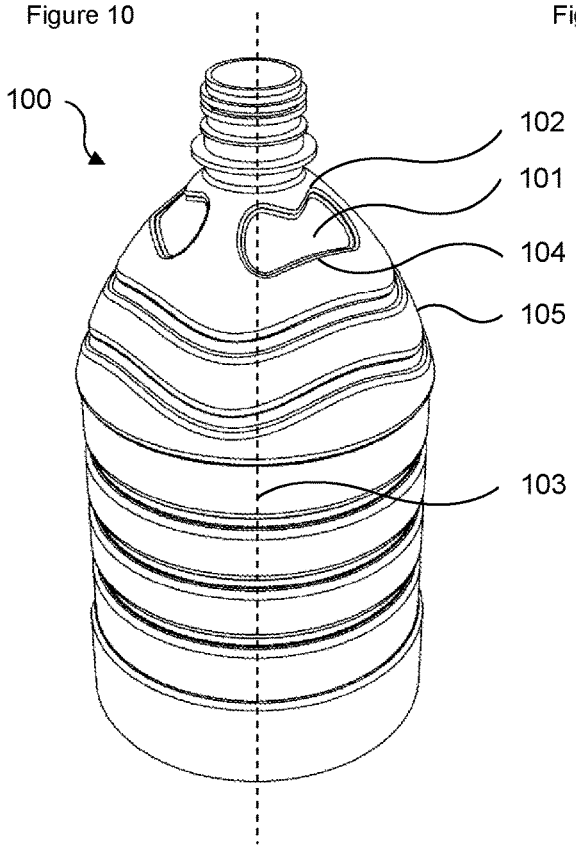
FIG. 10 is a perspective view of a fifth container according to the present invention in a start configuration.
Figure 11:
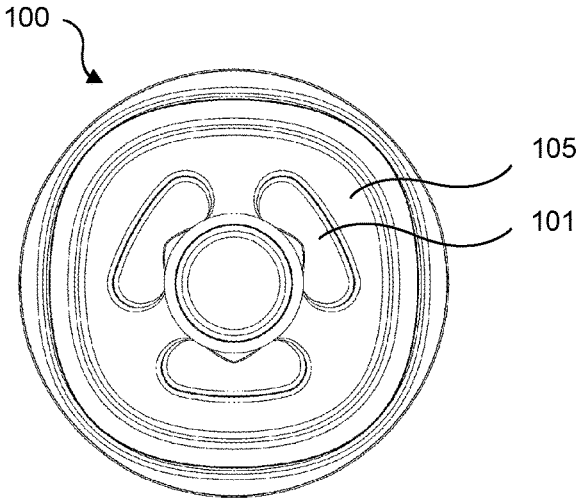
FIG. 11 is a top view of the fifth container as shown in FIG. 10.

Referring now to FIGS. 10 and 11, these show a fifth embodiment of the present invention in which bottle 100 is similar in shape and operation to bottle 80 described above, because it has three recessed areas 101. However, instead of being a curved shape, the recessed areas 101 each comprise an upper edge 102 which extends both axially and circumferentially in relation to the axis 103, and a lower edge 104 which also extends both axially and circumferentially in relation to the axis 103. In particular, as the upper edge 102 extends circumferentially around the shoulder 105 it rises, falls, rises and then falls again. Further, as the lower edge 104 extends circumferentially around the shoulder 105 is rises and then falls, to create the appearance of a straight line. As a result of these shapes the recessed area 101 has the appearance of an apple. The idea behind this version of the invention being that the recessed area has a shape which is relevant to the product in the bottle, for example an apple flavoured drink.

In use bottle 100 works in the same way as bottle 80 described above, although it will be appreciated that with this alternative shape of recessed area 101 the manner in which the shoulder 105 collapses will be different.

Figure 12:
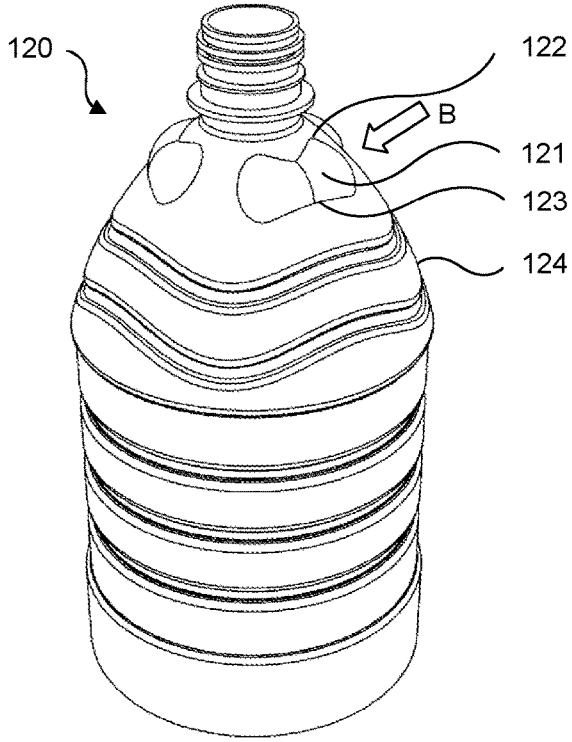
FIG. 12 is a perspective view of a sixth container according to the present invention in a start configuration.
Figure 13:
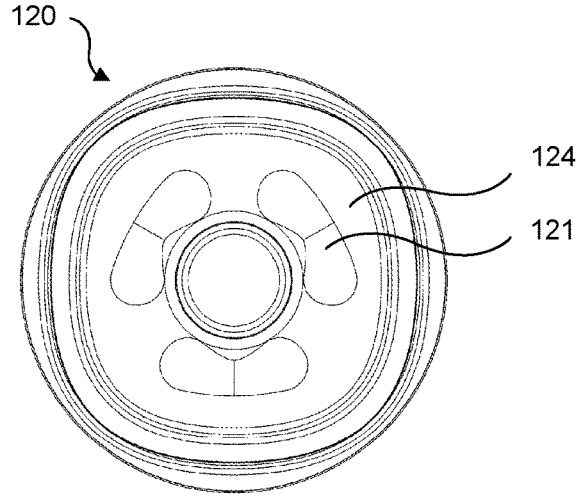
FIG. 13 is a top view of the sixth container as shown in FIG. 12.

Referring now to FIGS. 12 and 13, these show a sixth embodiment of the present invention in which bottle 120 is similar in shape and operation to bottle 100 described above, because it has three discontinuities which are each shaped like an apple, however instead of being recessed areas each discontinuity is a pronounced area 121 instead. Functionally these pronounced areas 121 operate in the same way as a recessed area, because they still comprise the same lines of weakness along the upper edge 122 and the lower edge 123, as in those locations the material of the bottle 120 is disrupted. Therefore, the application of force B will have generally the same effect. However, it will be appreciated that the manner in which the shoulder 124 collapses will differ, because the pronounced areas 121 may fail in a more outward direction than in an inward direction, which will create a different look, and possibly a different final spout angle.

Figure 14:
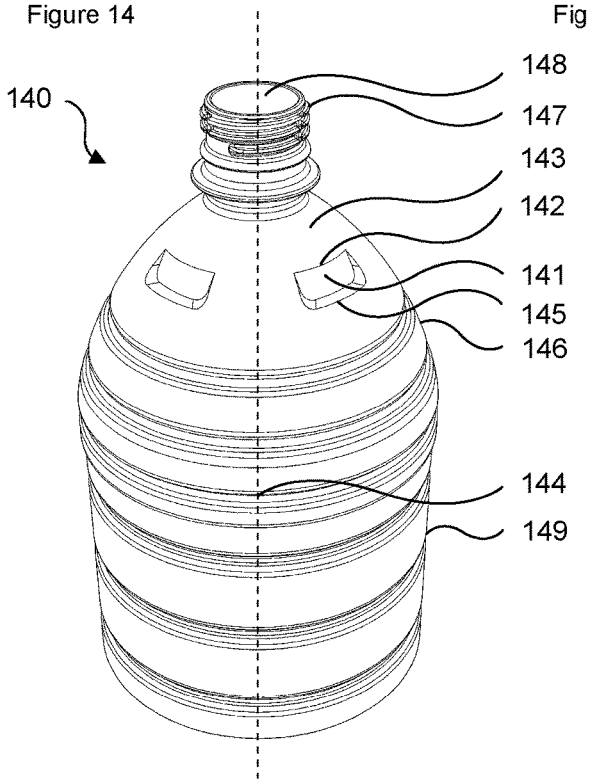
FIG. 14 is a perspective view of a seventh container according to the present invention in a start configuration.
Figure 15:
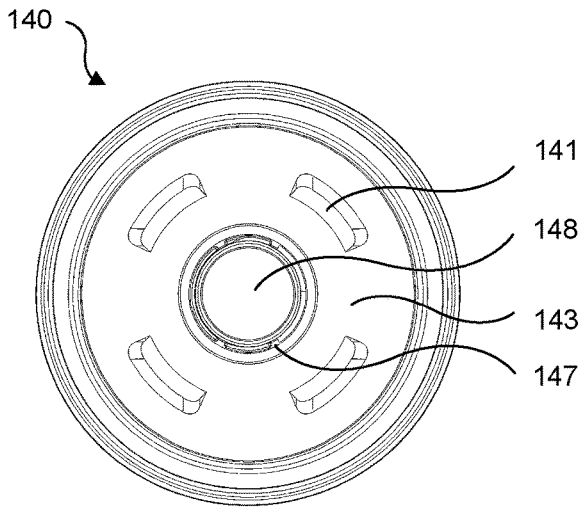
FIG. 15 is a top view of the seventh container as shown in FIG. 14.

Referring now to FIGS. 14 and 15, these show a seventh embodiment of the present invention, in which bottle 140 is similar in shape and operation to bottle 90 described above, because it has four recessed areas 141. However, instead of being recessed to the same extent across their area, each recessed area 141 has an upper edge 142 which is radially aligned with the bracing section 143 relative to the axis 144. The amount to which each recessed area 141 is recessed relative to the bracing section 143 then increases axially from the upper edge 142 to the lower edge 145. With this construction the recessed area 141 takes the form of a ramp on the inside surface of the shoulder 146 of the bottle 140, over which liquid can easily flow when the bottle is being filled.

This version of the invention is intended to allow for the bottle 140 to be filled quickly by having liquid sprayed along the interior walls of the neck 147 and shoulder 146 of the bottle leaving a central axial part 148 of the neck 147 free for the air in the bottle 140 to escape. This principal requires the neck 147 and shoulder 146 of the bottle 140 to be as free as possible from obstacles which could hinder the flow of the liquid along the shoulder 146 and into the main body 149 of the bottle 140, and this ramp shape of the recessed areas 141 achieves this.

In use the shoulder 146 of bottle 140 operates in the same way as shoulder 93 described above, and it can be collapsed in any of the same ways.

Figure 16:
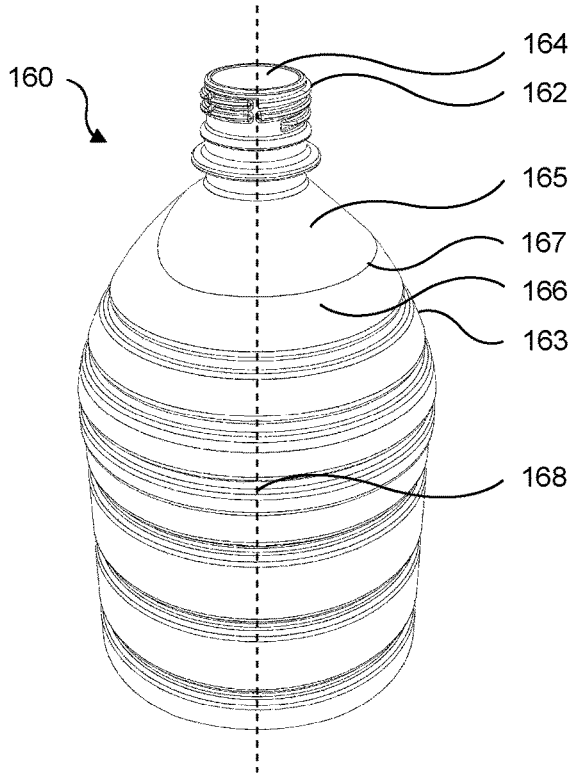
FIG. 16 is a perspective view of an eighth container according to the present invention in a start configuration.
Figure 17:
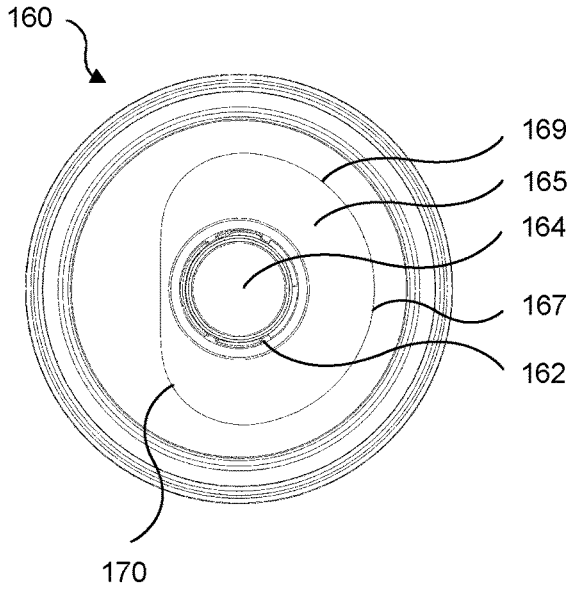
FIG. 17 is a top view of the eighth container as shown in FIG. 16.
Figure 18:
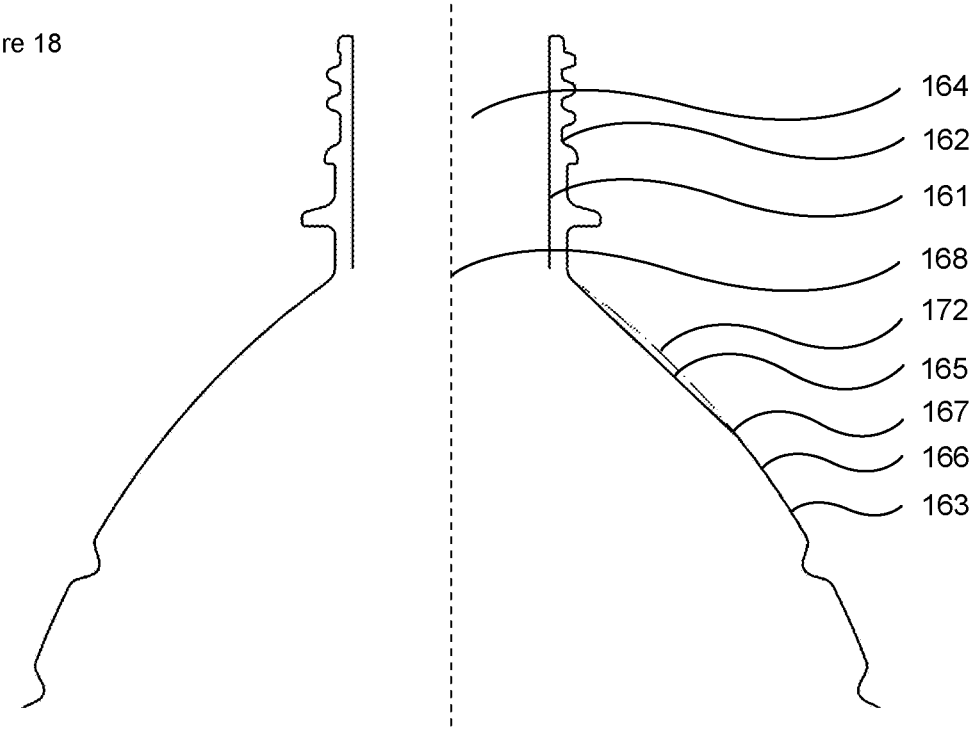
FIG. 18 is a diagrammatic cross-sectional view of a part of the eighth container as shown in FIG. 16.

Referring now to FIGS. 16 to 18, these show an eighth embodiment of the present invention in which bottle 160 is also intended to address the issues associated with filling bottles by spraying liquid along the interior walls 161 of the neck 162 and shoulder 163 of the bottle 160 leaving a central axial part 164 of the neck 162 free for the air in the bottle 160 to escape. As referred to above, this can only be achieved correctly if the neck and shoulder of a bottle are free from obstacles which would impede the flow of the liquid being introduced. In bottle 160 this is achieved by reducing the recessed nature of the recessed area 165 to the minimum possible, and by making the transition between the recessed area 165 and the bracing section 166 as smooth as possible. In order to still provide for a structurally weakened section which functions according to the invention, the footprint of the recessed area 165 is larger in size than in the various embodiments described above. In particular, the recessed area 165 comprises an outline 167 which extends around the axis 168, rather than just being on one side of it. Further, the outline 167 comprises a first section 169 which extends substantially 180 degrees around the axis 168 at a consistent first radial distance therefrom, and a second section 170 which extends substantially 180 degrees around the axis 168 at varying radial distances therefrom which are less than the first radial distance. Therefore, in this version of the invention the recessed area 165 is spread over a relatively large area of the shoulder 163 of the bottle 160, and actually encompasses the neck 162 of the bottle 160.

Referring to FIG. 18, this shows the recessed area 165 in relation to the normal curvature of the shoulder 163, which is shown by hashed line 172. As such the recessed area 165 is relatively shallow in comparison to those in the various embodiments described above. In addition, the transition between the recessed area 165 and the bracing section 166 in the region of the outline 167 is very smooth. Bottle 160 retains sufficient strength in its shoulder 163 to withstand the first force A without collapsing, despite the large footprint of the recessed area 165. It also collapses in a relatively regular manner, with the area inside the outline 167 rotating and the outline 167 neatly marking the contour of collapse.

In use the shoulder 163 of bottle 160 operates in the essentially same way as shoulder 3 described above, and it can be collapsed in the same ways using the same techniques.

Figure 19:
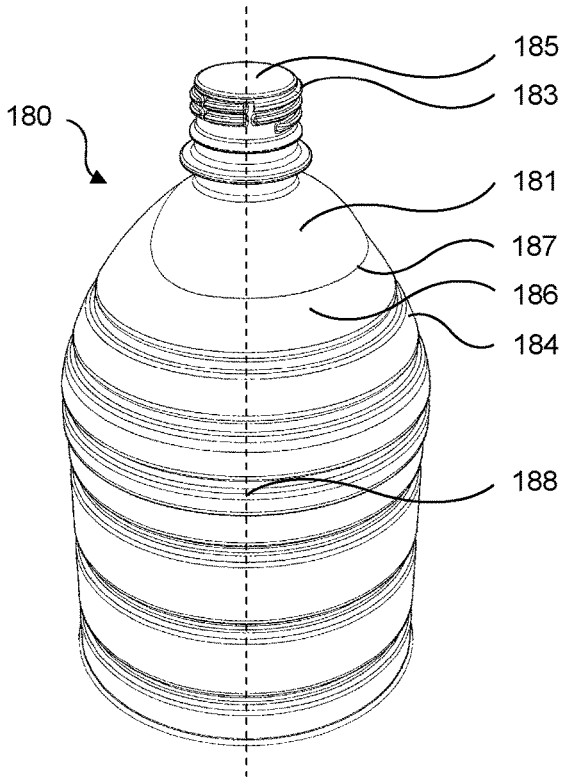
FIG. 19 is a perspective view of a ninth container according to the present invention in a start configuration.
Figure 20:
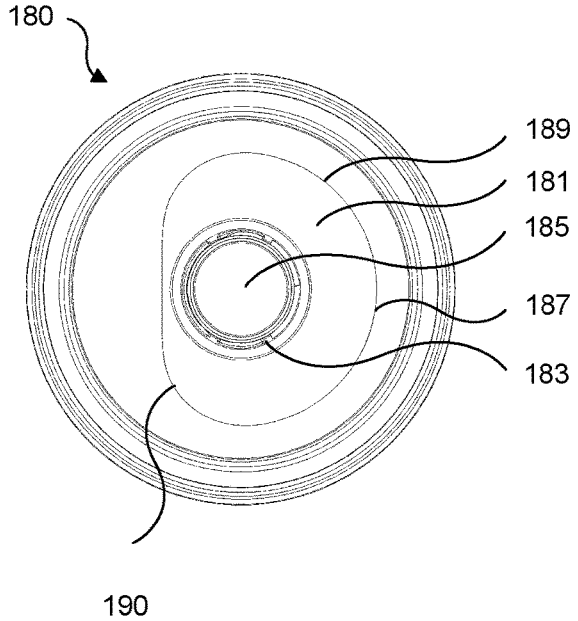
FIG. 20 is a top view of the eighth container as shown in FIG. 19.
Figure 21:
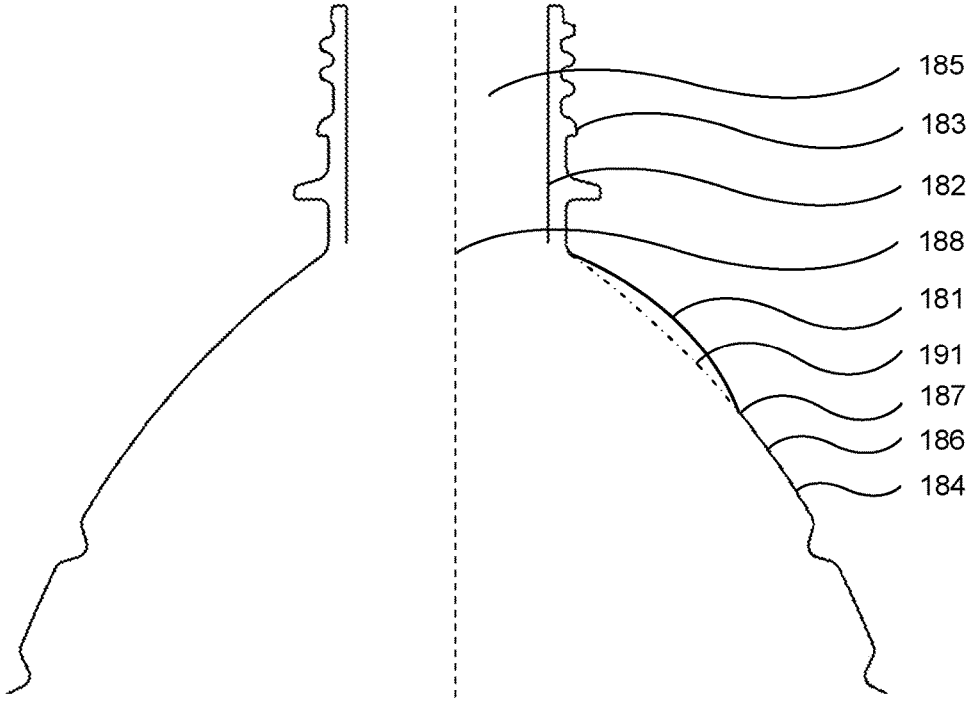
FIG. 21 is a diagrammatic cross-sectional view of a part of the ninth container as shown in FIG. 19.

Referring now to FIGS. 19 to 21, these show a ninth embodiment of the present invention which is similar to the eighth embodiment described above, but bottle 180 has a pronounced area 181 instead of a recessed one. As such bottle 180 is also intended to address the issues associated with filling bottles by spraying liquid along the interior walls 182 of the neck 183 and shoulder 184, leaving a central axial part 185 of the neck 183 free for the air in the bottle 180 to escape. As referred to above, this can only be achieved correctly if the neck and shoulder of a bottle are free from obstacles which would impede the flow of the liquid being introduced. In bottle 180 this is achieved by having a pronounced area 181 which does not protrude into the path of the liquid, but also by reducing the pronounced nature of the pronounced area 181 to the minimum possible, and by making the transition between the pronounced area 181 and the bracing section 186 as smooth as possible. In order to still provide for a structurally weakened section which functions according to the invention, the footprint of the pronounced area 181 is the same size and shape as recessed area 165 in bottle 160 described above, which is larger in size than in the various other embodiments described above. In particular, the pronounced area 181 comprises an outline 187 which extends around the axis 188, rather than just being on one side of it. Further, the outline 187 comprises a first section 189 which extends substantially 180 degrees around the axis 188 at a consistent first radial distance therefrom, and a second section 190 which extends substantially 180 degrees around the axis 188 at varying radial distances therefrom which are less than the first radial distance. Therefore, in this version of the invention the pronounced area 181 is spread over a relatively large area of the shoulder 184 of the bottle 180, and actually encompasses the neck 183 of the bottle 180.

Referring to FIG. 21, this shows the pronounced area 181 in relation to the normal curvature of the shoulder 184, which is shown by hashed line 191. As such the pronounced area 181 is relatively shallow in comparison the first to seventh embodiments described above. In addition, the transition between the pronounced area 181 and the bracing section 186 in the region of the outline 187 is very smooth. Bottle 180 retains sufficient strength in its shoulder 184 to withstand the first force A without collapsing, despite the large footprint of the pronounced area 181. It also collapses in a relatively regular manner, with the area inside the outline 187 rotating and the outline 187 neatly marking the contour of collapse.

In use the shoulder 184 of bottle 180 operates in the essentially same way as shoulder 3 described above, and it can be collapsed in the same ways using the same techniques.

The invention can be altered without departing from the scope of claim 1. In particular, in alternative embodiments (not shown) any combination of discontinuity shape and configuration features described above can be combined. For example, in one alternative embodiment a single pronounced area is provided. In another two apple shaped recessed areas are provided. In yet another two discontinuities are provided, one a recessed area and one a pronounced area. In yet another, one recess is provided which has an inverted ramp shape.

In another alternative embodiment (not shown) the structurally weakened section is provided by an area of reduced thickness as opposed to a discontinuity.

Therefore, the present invention provides a bottle which can achieve the benefits of an inclined outlet aperture for the end user without deviating from the known manufacturing, filling, capping, storage and transportation techniques. Furthermore, the invention provides a unique selling point for beverages, because the movement of the neck from the start configuration to the collapsed configuration can be seen as an interesting new way to interact with the product. In line with this the recessed or pronounced areas can be utilised for decoration or labelling.

The invention claimed is:

1. A container comprising a body portion, a collapsible shoulder portion, and an outlet aperture arranged on said collapsible shoulder portion, in which said collapsible shoulder portion comprises a base connected to said body portion, a top at which said outlet aperture is positioned and a central portion which tapers inwardly from said base to said top, in which said central portion comprises an axially and radially extending curvature shape, in which said collapsible shoulder portion is collapsible from a start configuration in which said outlet aperture is aligned with a longitudinal axis of said container, to a collapsed configuration in which said outlet aperture is rotated from said axis, in which said collapsible shoulder portion comprises a bracing section, being an area of said central portion which is shaped and configured to support said collapsible shoulder portion against collapse when said outlet aperture is subjected to a first force applied in line with said axis by transmitting said first force from said top to said base, in which said collapsible shoulder portion comprises a structurally weakened section which is shaped and configured to fail in a non-resilient manner when subjected to a second force applied from an offset angle to said axis, in which said structurally weakened section comprises a discontinuity area formed in an outer surface of said central portion, which discontinuity area comprises a single curved area of said outer surface which is displaced from the otherwise continuous axially and radially extending curvature shape of said central portion, which discontinuity extends both axially and circumferentially of said central portion and comprises an outline which surrounds said axis, and in which said outline comprises a first section which extends substantially 180 degrees around said axis at a constant first radial distance therefrom, and a second section which extends substantially 180 degrees around said axis at varying radial distances therefrom which are less than said first radial distance.

2. The container as claimed in claim 1 in which said discontinuity area comprises a recessed area of said outer surface.

3. The container as claimed in claim 1 in which said bracing section comprises a main part comprising said central portion other than said discontinuity area, and a secondary part comprising said discontinuity area, which secondary part transmits less of said first force from said top to said base than said main part.

4. The container as claimed in claim 1 in which said discontinuity area comprises a pronounced area of said outer surface.

5. The container as claimed in claim 1 in which said container comprises a cylindrical bottle constructed from a plastics material and in which said collapsible shoulder portion comprises an annular tapering shoulder of said bottle.

* * * * *